US011555396B2

(12) United States Patent
Romer et al.

(10) Patent No.: US 11,555,396 B2
(45) Date of Patent: Jan. 17, 2023

(54) SYSTEM AND METHOD FOR MEASURING DISCHARGE PARAMETERS RELATING TO AN ELECTRIC SUBMERSIBLE PUMP

(71) Applicant: ExxonMobil Upstream Research Company, Spring, TX (US)

(72) Inventors: Michael C. Romer, The Woodlands, TX (US); Wilfried Manfoumbi, Houston, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 112 days.

(21) Appl. No.: 17/336,474

(22) Filed: Jun. 2, 2021

(65) Prior Publication Data

US 2022/0049695 A1 Feb. 17, 2022

Related U.S. Application Data

(60) Provisional application No. 63/065,546, filed on Aug. 14, 2020.

(51) Int. Cl.

| | |
|---|---|
| ***E21B 47/008*** | (2012.01) |
| ***E21B 43/12*** | (2006.01) |
| ***F04B 17/03*** | (2006.01) |
| ***F04B 47/06*** | (2006.01) |

(52) U.S. Cl.

CPC ..... *E21B 47/008* (2020.05); *E21B 43/128* (2013.01); *F04B 17/03* (2013.01); *F04B 47/06* (2013.01)

(58) Field of Classification Search

CPC ..... E21B 47/008; E21B 43/128; F04B 17/03; F04B 47/06

See application file for complete search history.

(56) References Cited

U.S. PATENT DOCUMENTS

| | | | | |
|---|---|---|---|---|
| 3,916,685 | A * | 11/1975 | Paap | E21B 47/12 367/66 |
| 7,832,503 | B2 * | 11/2010 | Sand | E21B 4/00 175/320 |
| 9,121,270 | B2 * | 9/2015 | Seitter | E21B 43/128 |
| 9,388,812 | B2 | 7/2016 | Fastovets et al. | |

* cited by examiner

*Primary Examiner* — D. Andrews

(74) *Attorney, Agent, or Firm* — ExxonMobil Upstream Research Company—Law Department

(57) ABSTRACT

An electric submersible pump (ESP) monitoring system is described herein. The ESP monitoring system includes a base monitoring unit and a discharge monitoring unit that are communicably coupled via a ground path. The discharge monitoring unit is hydraulically coupled to the pump discharge and is configured to measure a discharge parameter relating to the pump discharge and transmit data corresponding to the discharge parameter to the base monitoring unit via the ground path. The base monitoring unit is electrically connected to the motor of the ESP system and is configured to measure a base parameter relating to the motor and/or the pump intake, receive the transmitted data corresponding to the discharge parameter from the discharge monitoring unit, combine the data corresponding to the discharge parameter and the data corresponding to the base parameter, and transmit the combined data to an ESP surface unit via an ESP power cable.

25 Claims, 6 Drawing Sheets

[ Prior Art ]

100

200

202

146

500

600

SYSTEM AND METHOD FOR MEASURING DISCHARGE PARAMETERS RELATING TO AN ELECTRIC SUBMERSIBLE PUMP

CROSS REFERENCE TO RELATED APPLICATIONS

This application claims the benefit of U.S. Provisional Application No. 63/065,546, filed Aug. 14, 2020, the disclosure of which is incorporated herein by reference in its entirety.

FIELD OF THE INVENTION

The techniques described herein relate to the field of artificial lift technology for hydrocarbon wells. More particularly, the techniques described herein relate to electric submersible pumps (ESPs).

BACKGROUND OF THE INVENTION

This section is intended to introduce various aspects of the art, which may be associated with embodiments of the present techniques. This discussion is believed to assist in providing a framework to facilitate a better understanding of particular aspects of the present techniques. Accordingly, it should be understood that this section should be read in this light, and not necessarily as admissions of prior art.

Artificial lift includes a number of methods for transporting produced hydrocarbon fluids within a wellbore to the surface when reservoir pressure alone is not sufficient. While many hydrocarbon wells initially have sufficient reservoir pressure to force hydrocarbon fluids from the reservoir to the surface, the reservoir pressure declines as production continues. As a result, more than 60% of hydrocarbon wells require the use of one or more artificial lift methods to boost production.

One common artificial lift method involves using electric submersible pump (ESP) systems to lift hydrocarbon fluids to the surface. More than 15% of hydrocarbon wells worldwide utilize some form of ESP system to aid with production. In fact, ESP systems are the fastest-growing form of artificial lift pumping technology. ESP systems are very versatile and are capable of operating in high-volume, high-depth environments. For example, a typical ESP system can handle flow rates in excess of 30,000 barrels per day (bpd) and can provide more than 15,000 feet of lift.

However, ESP systems have relatively short run lives. Specifically, an average ESP system has a run life of 2-3 years, with a run life in excess of 5 years being uncommon. The run life of an ESP system is generally determined by the environment in which it operates, as well as by the manner in which it is operated. Moreover, because ESP systems are typically attached to the production tubing and installed with a rig, ESP installation and replacement workovers can be relatively expensive. Therefore, ESP operators spend considerable time on ESP reliability initiatives, since each additional day of run time improves the overall project economics.

ESP operators typically monitor ESP system performance using monitoring units that are installed below the ESP motor, i.e., via electrical connection to the motor wye point. Such monitoring units include sensors that provide for the direct measurement of key parameters relating to the ESP motor and the pump intake, such as, for example, downhole vibration, motor oil temperature, motor winding temperature, intake pressure, intake temperature, water ingress, current leakage, wye voltage, and the like. These measurements are communicated to an ESP surface unit via the ESP power cable.

The ESP operator then uses the information provided by these measurements for ESP surveillance, troubleshooting, and optimization. For example, the ESP operator may use the information to proactively intervene when the performance of the ESP system is gradually declining. In this manner, such information can be used to extend the run life of the ESP system, as well as boost production from the hydrocarbon well. In addition, in some cases, such information can provide helpful insight into the characteristics of the reservoir, which may be used to further improve production.

The discharge pressure of the pump is one important parameter that is not directly measured by a typical ESP monitoring unit. The discharge pressure can be used to calculate the differential pressure across the pump to evaluate its performance and to quickly identify a potential deadhead condition. In addition, the discharge pressure can be used to determine the hydrostatic pressure gradient in the production tubing above the ESP system.

According to current techniques, ESP monitoring units can be configured to determine the pump discharge pressure by using a hydraulic line to attach the monitoring unit to a pump discharge sub installed above the pump discharge. This enables the monitoring unit to measure the discharge pressure applied to the hydraulic line by the pump. The hydraulic line is typically 0.25 to 0.375 inches in diameter and is banded to the outside of the pump, protector, and motor of the ESP system. In addition, the hydraulic line may be more than 100 feet long, depending on the distance from the monitoring unit to the pump discharge. As a result, this technique for measuring the discharge pressure increases the overall outer diameter of the ESP system. Therefore, this solution may not be an option when the inner diameter of the casing is limited, such as, for example, when heavy-walled casing is used. Moreover, while slim-line and tight-clearance ESP systems do exist, such systems are less reliable than standard-sized ESP systems and often have production and horsepower limitations.

U.S. Pat. No. 9,388,812 B2, entitled "Wireless Sensor System for Electric Submersible Pump," provides a wired or wireless remote unit for measuring pump discharge pressure. However, the wired solution relies on the use of a wired interface between the remote unit and the base unit. If small wires are used for this purpose, the wires may not survive the ESP installation process. Moreover, if large wires are used for this purpose, the ESP system would suffer from the same issue that is encountered when using a hydraulic line to connect the two units. i.e., the increase in the overall outer diameter. Furthermore, the wireless solution suffers from intrinsic unreliability due to the unknown composition of the downhole transmission medium, i.e., the gas and liquid between the ESP system and the casing annulus. Therefore, there exists a need for reliable techniques for measuring pump discharge pressures without increasing the overall outer diameters of ESP systems.

SUMMARY OF THE INVENTION

An embodiment described herein provides an electric submersible pump (ESP) monitoring system. The ESP monitoring system includes a base monitoring unit and a discharge monitoring unit that is communicably coupled to the base monitoring unit via a ground path. The discharge monitoring unit is hydraulically coupled to a pump discharge of a pump of the ESP system and is configured to measure at least one discharge parameter relating to the pump discharge and transmit data corresponding to the at least one discharge parameter to a base monitoring unit via the ESP power cable. The base monitoring unit is electrically connected to a motor of the ESP system. The base monitoring unit is configured to measure at least one base parameter relating to the motor and/or a pump intake of the pump, receive the transmitted data corresponding to the at least one discharge parameter from the discharge monitoring unit, combine the data corresponding to the at least one discharge parameter and the data corresponding to the at least one base parameter, and transmit the combined data to an ESP surface unit via the ESP power cable.

In various embodiments, the ground path is the armor of the ESP power cable. In other embodiments, the ground path is any combination of the armor of the ESP power cable, a housing of one or more components of the ESP system, a production tubing, and a casing of a wellbore.

In some embodiments, the at least one base parameter includes at least one of a downhole vibration, a motor oil temperature, a motor winding temperature, an intake pressure, an intake temperature, a water ingress, a current leakage, and a wye voltage. In addition, in some embodiments, the at least one discharge parameter includes at least one of a discharge pressure, a discharge temperature, or a vibration near the pump discharge.

In some embodiments, the discharge monitoring unit is configured to measure the at least one discharge parameter by recording a pressure signal, convert the pressure signal to an output frequency, and transmit the output frequency to the base monitoring unit as the data corresponding to the at least one discharge parameter. In addition, in some embodiments, the base monitoring unit is electrically connected to a motor wye point of the motor and is configured to receive the transmitted data from the discharge monitoring unit by reading the output frequency from the ground path using the motor wye point as a reference, convert the output frequency to pressure information, combine the pressure information with any pressure information recorded by the base monitoring unit, and transmit the combined pressure information to the ESP surface unit via the ESP power cable. Further, in some embodiments, the discharge monitoring unit converts the pressure signal to an output voltage or an output current rather than the output frequency.

In some embodiments, the discharge monitoring unit includes a pressure transducer that is rated for downhole conditions. In some embodiments, the transmission from the base monitoring unit to the ESP surface unit is configured to overwhelm the transmission from the discharge monitoring unit to the base monitoring unit to ensure that the combined data reach the ESP surface unit. In addition, in some embodiments, the base monitoring unit is configured to alternate between receiving the transmitted data from the discharge monitoring unit and transmitting the combined data to the ESP surface unit.

In some embodiments, the base monitoring unit is configured to request the data corresponding to the at least one discharge parameter from the discharge monitoring unit. In some embodiments, the base monitoring unit is configured to send the requests to the discharge monitoring unit in a cycle such that the data corresponding to each discharge parameter are transmitted separately.

In various embodiments, the discharge monitoring unit includes a power source. In some embodiments, the power source includes a power-generation device that is configured to generate power downhole.

Another embodiment described herein provides a method for measuring and transmitting parameters relating to an ESP system. The method includes providing an ESP monitoring system, wherein the ESP monitoring system includes a base monitoring unit and a discharge monitoring unit that are communicably coupled via a ground path. The discharge monitoring unit is hydraulically coupled to a pump discharge of a pump of the ESP system, and the base monitoring unit is electrically connected to a motor of the ESP system. The method also includes measuring at least one base parameter relating to the motor and/or a pump intake of the pump using the base monitoring unit and measuring at least one discharge parameter relating to the pump discharge using the discharge monitoring unit. The method further includes transmitting data corresponding to the at least one discharge parameter from the discharge monitoring unit to the base monitoring unit via a ground path, combining, via the base monitoring unit, the data corresponding to the at least one discharge parameter and the data corresponding to the at least one base parameter, and transmitting the combined data from the base monitoring unit to an ESP surface unit via the ESP power cable.

In various embodiments, transmitting the data corresponding to the at least one discharge parameter via the ground path includes transmitting the data via an armor of the ESP power cable. In other embodiments, transmitting the data corresponding to the at least one discharge parameter via the ground path includes transmitting the data via any combination of an armor of the ESP power cable, a housing of one or more components of the ESP system, a production tubing, and a casing of a wellbore.

In some embodiments, measuring the at least one base parameter includes measuring at least one of a downhole vibration, a motor oil temperature, a motor winding temperature, an intake pressure, an intake temperature, a water ingress, a current leakage, and a wye voltage. Furthermore, in some embodiments, measuring the at least one discharge parameter includes measuring at least one of a discharge pressure, a discharge temperature, or a vibration near the pump discharge.

In some embodiments, the method includes measuring, via the discharge monitoring unit, the at least one discharge parameter by recording a pressure signal, converting, via the discharge monitoring unit, the pressure signal to an output frequency, and transmitting the output frequency from the discharge monitoring unit to the base monitoring unit as the data corresponding to the at least one discharge parameter. In some embodiments, the method also includes reading, via the base monitoring unit, the output frequency from the ground path using a motor wye point as a reference, converting, via the base monitoring unit, the output frequency to pressure information, and combining, via the base monitoring unit, the pressure information with any pressure information recorded by the base monitoring unit, and transmitting the combined pressure information from the base monitoring unit to the ESP surface unit via the ESP power cable. Moreover, in some embodiments, the method includes converting the pressure signal to an output voltage or an output current rather than the output frequency.

In some embodiments, the method includes powering the discharge monitoring unit via a power source that is coupled to the discharge monitoring unit. In other embodiments, the method includes powering the discharge monitoring unit via the ESP power cable.

In some embodiments, the method includes overwhelming the transmission from the discharge monitoring unit to the base monitoring unit with the transmission from the base monitoring unit to the ESP surface unit to ensure that the combined data reach the ESP surface unit. In some embodiments, the method includes alternating, via the base monitoring unit, between receiving the transmitted data from the discharge monitoring unit at the base monitoring unit and transmitting the combined data from the base monitoring unit to the ESP surface unit.

In some embodiments, the method includes requesting, via the base monitoring unit, the data corresponding to the at least one discharge parameter from the discharge monitoring unit. In some embodiments, this includes sending, via the base monitoring unit, the requests to the discharge monitoring unit in a cycle such that the data corresponding to each discharge parameter are transmitted separately.

Another embodiment described herein provides an ESP system. The ESP system includes a shaft, a motor configured to rotate the shaft in response to receiving power via an ESP power cable, and a pump that is operatively coupled to the shaft, wherein the pump includes a pump intake and a pump discharge. The ESP system also includes an ESP monitoring system. The ESP monitoring system includes a discharge monitoring unit that is hydraulically coupled to the pump discharge and is configured to measure at least one discharge parameter relating to the pump discharge and transmit data corresponding to the at least one discharge parameter to a base monitoring unit via a ground path. The ESP monitoring system also includes a base monitoring unit that is electrically connected to the motor. The base monitoring unit is configured to measure at least one base parameter relating to the motor and/or the pump intake, receive the transmitted data corresponding to the at least one discharge parameter from the discharge monitoring unit, combine the data corresponding to the at least one discharge parameter and the data corresponding to the at least one base parameter, and transmit the combined data to an ESP surface unit via the ESP power cable.

In various embodiments, the ground path is the armor of the ESP power cable. In other embodiments, the ground path is any combination of the armor of the ESP power cable, a housing of one or more components of the ESP system, a production tubing, and a casing of a wellbore.

In some embodiments, the at least one base parameter includes at least one of a downhole vibration, a motor oil temperature, a motor winding temperature, an intake pressure, an intake temperature, a water ingress, a current leakage, and a wye voltage. In addition, in some embodiments, the at least one discharge parameter includes at least one of a discharge pressure, a discharge temperature, or a vibration near the pump discharge.

In some embodiments, the discharge monitoring unit is configured to measure the at least one discharge parameter by recording a pressure signal, convert the pressure signal to an output frequency, and transmit the output frequency to the base monitoring unit as the data corresponding to the at least one discharge parameter. In addition, in some embodiments, the base monitoring unit is electrically connected to a motor wye point of the motor and is configured to receive the transmitted data from the discharge monitoring unit by reading the output frequency from the ground path using the motor wye point as a reference, convert the output frequency to pressure information, combine the pressure information with any pressure information recorded by the base monitoring unit, and transmit the combined pressure information to the ESP surface unit via the ESP power cable. Further, in some embodiments, the discharge monitoring unit converts the pressure signal to an output voltage or an output current rather than the output frequency.

In some embodiments, the discharge monitoring unit includes a pressure transducer that is rated for downhole conditions. In some embodiments, the transmission from the base monitoring unit to the ESP surface unit is configured to overwhelm the transmission from the discharge monitoring unit to the base monitoring unit to ensure that the combined data reach the ESP surface unit. In addition, in some embodiments, the base monitoring unit is configured to alternate between receiving the transmitted data from the discharge monitoring unit and transmitting the combined data to the ESP surface unit.

In some embodiments, the base monitoring unit is configured to request the data corresponding to the at least one discharge parameter from the discharge monitoring unit. In some embodiments, the base monitoring unit is configured to send the requests to the discharge monitoring unit in a cycle such that the data corresponding to each discharge parameter are transmitted separately.

In various embodiments, the discharge monitoring unit includes a power source. In some embodiments, the power source includes a power-generation device that is configured to generate power downhole.

BRIEF DESCRIPTION OF THE DRAWINGS

The foregoing and other advantages of the present techniques may become apparent upon reviewing the following detailed description and drawings of non-limiting examples.

Figure 1:
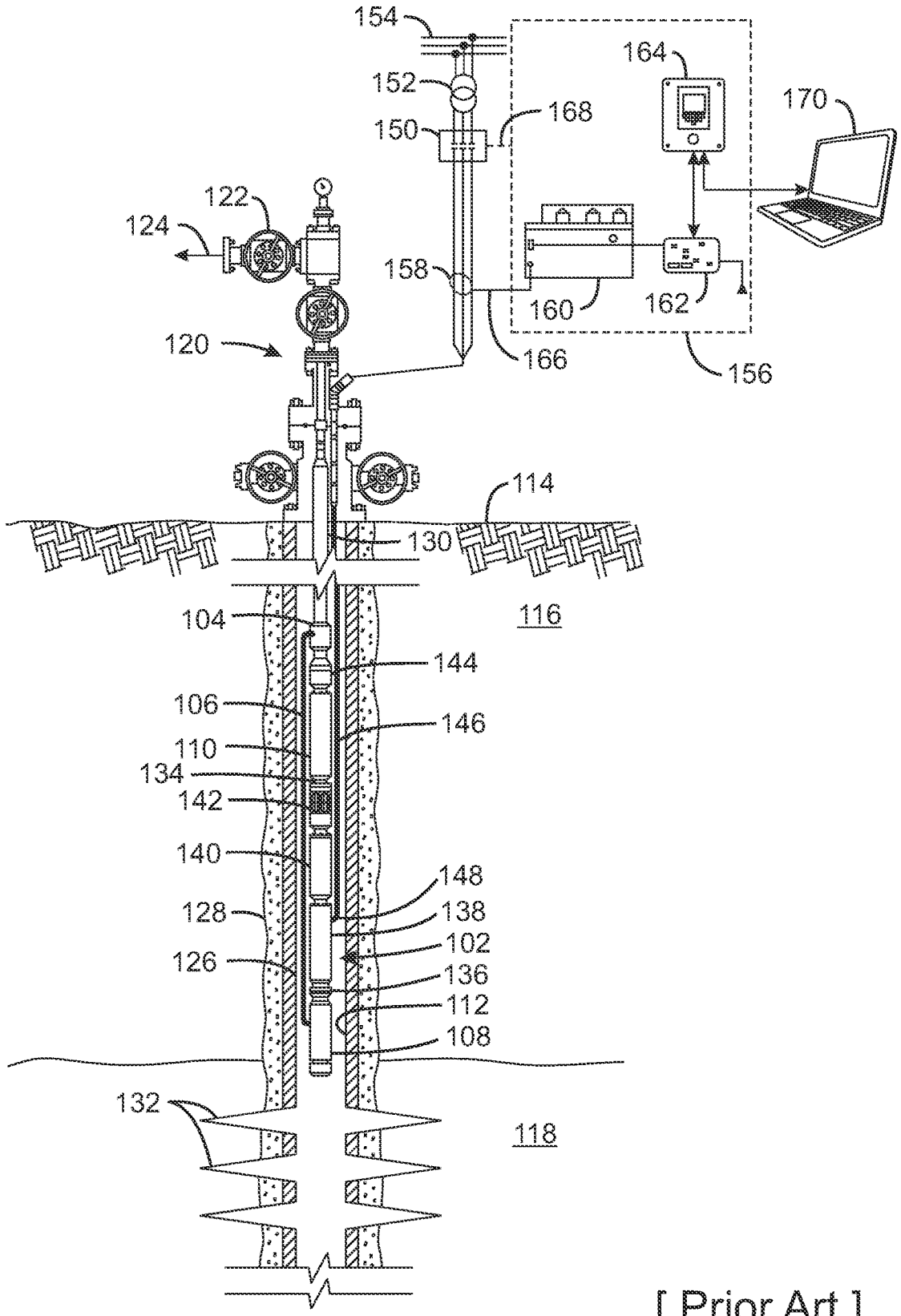
FIG. 1 is a cross-sectional schematic view of an exemplary hydrocarbon well including an electric submersible pump (ESP) system with a pump discharge sub and a hydraulic line that enable a monitoring unit to measure the discharge pressure of a pump.

It should be noted that the figures are merely examples of the present techniques, and no limitations on the scope of the present techniques are intended thereby. Further, the figures are generally not drawn to scale, but are drafted for purposes of convenience and clarity in illustrating various aspects of the techniques.

DETAILED DESCRIPTION OF THE INVENTION

In the following detailed description section, the specific examples of the present techniques are described in connection with preferred embodiments. However, to the extent that the following description is specific to a particular embodiment or a particular use of the present techniques, this is intended to be for example purposes only and simply provides a description of the embodiments. Accordingly, the techniques are not limited to the specific embodiments described below, but rather, include all alternatives, modifications, and equivalents falling within the true spirit and scope of the appended claims.

At the outset, and for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As used herein, the terms "a" and "an" mean one or more when applied to any embodiment described herein. The use of "a" and "an" does not limit the meaning to a single feature unless such a limit is specifically stated.

The term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "including," may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

The phrase "at least one," in reference to a list of one or more entities, should be understood to mean at least one entity selected from any one or more of the entities in the list of entities, but not necessarily including at least one of each and every entity specifically listed within the list of entities, and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently, "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

As used herein, the term "configured" mean that the element, component, or other subject matter is designed and/or intended to perform a given function. Thus, the use of the term "configured" should not be construed to mean that a given element, component, or other subject matter is simply "capable of" performing a given function but that the element, component, and/or other subject matter is specifically selected, created, implemented, utilized, and/or designed for the purpose of performing the function.

As used herein, the term "deadhead condition" refers to the failure of an ESP system's lifting capabilities due to one or more unfavorable conditions, such as the application of excessive downward thrust on the ESP pump and/or the overheating of the ESP motor due to fluid accumulation in the casing string of the hydrocarbon well.

The term "differential pressure" refers to the change in unit force per unit area between two points within a system or, more generally, to the difference between two pressure measurements. As used herein, the term "differential pressure" is used to describe the change in force per unit area measured across a downhole tool, such as a downhole pump. In various embodiments, the differential pressure across a downhole pump is measured by calculating the difference between the pump intake pressure and the pump discharge pressure.

As used herein, the terms "example," exemplary," and "embodiment," when used with reference to one or more components, features, structures, or methods according to the present techniques, are intended to convey that the described component, feature, structure, or method is an illustrative, non-exclusive example of components, features, structures, or methods according to the present techniques. Thus, the described component, feature, structure or method is not intended to be limiting, required, or exclusive/exhaustive; and other components, features, structures, or methods, including structurally and/or functionally similar and/or equivalent components, features, structures, or methods, are also within the scope of the present techniques.

As used herein, the term "fluid" refers to gases, liquids, and combinations of gases and liquids, as well as to combinations of gases and solids, and combinations of liquids and solids.

"Formation" refers to a subsurface region including an aggregation of subsurface sedimentary, metamorphic and/or igneous matter, whether consolidated or unconsolidated, and other subsurface matter, whether in a solid, semi-solid, liquid and/or gaseous state, related to the geological development of the subsurface region. A formation can be a body of geologic strata of predominantly one type of rock or a combination of types of rock, or a fraction of strata having substantially common sets of characteristics. A formation can contain one or more hydrocarbon-bearing subterranean formations. Note that the terms "formation," "reservoir," and "interval" may be used interchangeably, but may generally be used to denote progressively smaller subsurface regions, zones, or volumes. More specifically, a "formation" may generally be the largest subsurface region, while a "reservoir" may generally be a hydrocarbon-bearing zone or interval within the geologic formation that includes a relatively high percentage of oil and gas. Moreover, an "interval" may generally be a sub-region or portion of a reservoir. In some cases, a hydrocarbon-bearing zone, or reservoir, may be separated from other hydrocarbon-bearing zones by zones of lower permeability, such as mudstones, shales, or shale-like (i.e., highly-compacted) sands.

A "hydrocarbon" is an organic compound that primarily includes the elements hydrogen and carbon, although nitrogen, sulfur, oxygen, metals, or any number of other elements may be present in small amounts. As used herein, the term "hydrocarbon" generally refers to components found in natural gas, oil, or chemical processing facilities. Moreover, the term "hydrocarbon" may refer to components found in raw natural gas, such as $CH_4$, $C_2H_6$, $C_3$ isomers, $C_4$ isomers, benzene, and the like.

As used herein, the term "hydrostatic pressure gradient" refers to the rate of change in fluid pressure with depth within a wellbore tubular. Typically, the fluid density within the wellbore tubular is the controlling factor for the hydrostatic pressure gradient. Therefore, the hydrostatic pressure gradient can be used to monitor changes in fluid composition within the wellbore tubular.

The term "pressure" refers to a force acting on a unit area. Pressure is usually shown as pounds per square inch (psi).

The term "pressure transducer" refers to a device used to measure pressure and convert it to an output frequency or electrical signal.

As used herein, the term "production tubing" refers to a wellbore tubular that is connected to an electric submersible pump (ESP) discharge and is used to produce hydrocarbon fluids from a reservoir.

As used herein, the term "surface" refers to the uppermost land surface of a land well, or the mud line of an offshore well, while the term "subsurface" (or "subterranean") generally refers to a geologic strata occurring below the earth's surface. Moreover, as used herein, "surface" and "subsurface" are relative terms. The fact that a particular piece of equipment is described as being on the surface does not necessarily mean it must be physically above the surface of the earth but, rather, describes only the relative placement of the surface and subsurface pieces of equipment. In that sense, the term "surface" may generally refer to any equipment that is located above the casing, production tubing, and other equipment that is located inside the wellbore. Moreover, according to embodiments described herein, the terms "downhole" and "subsurface" are sometimes used interchangeably, although the term "downhole" is generally used to refer specifically to the inside of the wellbore.

The term "wellbore" refers to a hole drilled vertically, at least in part, and may also refer to a hole drilled with deviated, highly deviated, and/or horizontal sections. The term "hydrocarbon well" includes the wellbore as well as the associated equipment, such as the wellhead, casing string(s), production tubing, and the like.

Embodiments described herein provide an electric submersible pump (ESP) monitoring system that is installed within an ESP system, as well as a method for measuring and transmitting pump discharge parameters using the ESP monitoring system. In various embodiments, the ESP monitoring system includes a base monitoring unit and a discharge monitoring unit that are communicably coupled via a ground path, which may be provided by the armor of the ESP power cable, the housing of one or more components of the ESP system, the production tubing, and/or the casing of the wellbore. The discharge monitoring unit is configured to measure pump discharge parameters, such as the discharge pressure, discharge temperature, and/or vibration near the pump discharge, and transmit data relating to the pump discharge parameters to the base monitoring unit via the ground path. Moreover, the base monitoring unit is configured to measure motor parameters and/or pump intake parameters, combine the measured data with the data received from the discharge monitoring unit, and transmit the combined data to an ESP surface unit via the ESP power cable. In various embodiments, integrating the discharge monitoring unit with the base monitoring unit using the ground path allows pump discharge parameters to be reliably measured and transmitted without increasing the overall outer diameter of the ESP system. Exemplary Hydrocarbon Well including ESP System with Conventional Monitoring Unit and Pump Discharge Sub Attached via Hydraulic Line FIG. 1 is a cross-sectional schematic view of a hydrocarbon well 100 including an electric submersible pump (ESP) system 102 with a pump discharge sub 104 and a hydraulic line 106 that enable a monitoring unit 108 to measure the discharge pressure of a pump 110. The hydrocarbon well 100 defines a wellbore 112 that extends from a surface 114 into a formation 116 within the earth's subsurface. The formation 116 may include several subsurface intervals, such as a hydrocarbon-bearing interval that is referred to herein as a reservoir 118.

The hydrocarbon well 100 also includes a wellhead 120. The wellhead 120 includes a number of pipes, valves, gauges, and other instrumentation for controlling the hydrocarbon well 100. For example, the wellhead 120 includes a wing valve 122 that controls the flow of hydrocarbon fluids from the wellbore 112, as indicated by arrow 124.

The hydrocarbon well 100 is completed by setting a series of tubulars, referred to as casing strings, into the formation 116. The simplified schematic of FIG. 1 depicts a hydrocarbon well 100 with a single casing string, which is referred to as the production casing string 126. However, it will be appreciated by one of skill in the art that the hydrocarbon well 100 may often include a number of different casing strings, such as a surface casing string, one or more intermediate casing strings, and the production casing string 126. Moreover, each casing string may be either hung from the surface 114 or from the bottom of the previous casing string using a liner hanger. As shown in FIG. 1, the production casing string 126 (as well as any surface and intermediate casing strings) is set in place using cement 128. The cement 128 isolates the intervals of the formation 116 from the hydrocarbon well 100 and each other. Alternatively, in some embodiments, the hydrocarbon well 100 may be set as an open-hole completion, meaning that the production casing string 126 is not set in place using cement.

The hydrocarbon well 100 includes production tubing 130 extending through the production casing string 126. In addition, the portion of the production casing string 126 extending into the reservoir 118 includes a number of perforations 132 that allow hydrocarbon fluids within the reservoir 118 to flow into the hydrocarbon well 100 and up the production tubing 130 to the surface 114. While the embodiment shown in FIG. 1 includes only one set of perforations 132, it will be appreciated by one of skill in the art that the hydrocarbon well 100 may include many separate stages extending through the reservoir 118, where each stage includes several sets of perforations. Moreover, while the simplified schematic view of FIG. 1 depicts the hydrocarbon well 100 as a vertical well, it will be appreciated by one of skill in the art that the hydrocarbon well 100 may include one or more lateral or deviated sections extending through the reservoir 118.

In many cases, the pressure within the reservoir 118 is initially high enough to force hydrocarbon fluids to the surface 114 without any assistance. However, as production continues, the reservoir pressure declines, causing the flow rate of the hydrocarbon fluids to decrease. Therefore, according to embodiments described herein, the hydrocarbon well 100 includes the electric submersible pump (ESP) system 102. The ESP system 102 provides artificial lift capabilities, boosting produced hydrocarbon fluids to the surface 114 when reservoir pressure alone is not sufficient.

According to the embodiment shown in FIG. 1, the ESP system 102 is attached to, and installed with, the production tubing 130. However, in other embodiments, the ESP system 102 may be installed in any other suitable manner, such as via coiled tubing, for example.

In various embodiments, the ESP system 102 includes a number of components that are attached to a shaft 134. Specifically, the ESP system 102 includes the monitoring unit 108, a motor base crossover 136, a motor 138, a protector 140, a pump intake 142, the pump 110, and a pump discharge 144. In operation, the produced hydrocarbon fluids enter the pump 110 via the pump intake 142. Because ESP systems have lower efficiencies in high gas/oil ratio (GOR) scenarios, the pump intake 142 may include a gas separator for removing free gas from the hydrocarbon fluids before the hydrocarbon fluids enter the pump 110. In some embodiments, the gas separator is a rotary gas separator that uses centrifugal force to separate the free gas from the liquids within the hydrocarbon fluids.

In various embodiments, the pump 110 is a multi-stage, centrifugal pump, where each stage within the pump 110 includes a rotating impeller and a stationary diffuser that sequentially increases the velocity and pressure of the hydrocarbon fluids flowing through the pump 110. In operation, the motor 138 spins the shaft 134, which rotates the impeller within each stage. This, in turn, increases the pressure of the pumped hydrocarbon fluids so that the hydrocarbon fluids can be produced to the surface 114. Because ESP systems are typically designed to fit in casing strings with limited inner diameters, the lift provided by each stage is relatively low. Therefore, many stages are stacked together within the pump housing to provide the desired amount of lift for the particular application.

In some embodiments, the motor 138 is a three-phase, squirrel-cage AC induction motor. In other embodiments, the motor 138 is a permanent magnet motor. The motor 138 is designed to work in high-temperature, high-pressure environments. The motor 138 may be filled with oil that provides dielectric strength and bearing lubrication, as well as a thermal pathway for dissipating heat generated by the motor windings.

The motor 138 is powered by an ESP power cable 146 that is connected to the motor 138 via a power cable connector 148, which may be referred to as a "pothead connector." The ESP power cable 146 extends through the wellbore 112 and through the wellhead 120 at the surface 114. In various embodiments, the ESP power cable 146 is an armored, three-phase electrical power cable, as described further herein. The ESP power cable 146 is connected to a switchboard or variable speed drive (VSD) 150, a transformer 152, and an electrical supply system 154, such as a commercial power distribution system, located at the surface 114.

The protector 140, which is also referred to as the "seal section", of the ESP system 102 protects the motor 138 from contamination by wellbore fluids. In addition, the protector 140 equalizes the pressure between the motor 138 and the wellbore 112, absorbs a substantial portion of the thrust load from the pump 110, and handles the thermal expansion of the oil within the motor 138.

The monitoring unit 108 is connected to the motor 138 via the motor base crossover 136. Specifically, the monitoring unit 108 is electrically connected to the motor wye point within the motor base crossover 136, which carries a secondary AC power signal to the monitoring unit 108. In various embodiments, the monitoring unit 108 includes DC power conversion circuitry that is configured to convert the AC power signal into a DC power signal that is suitable for powering the components of the monitoring unit 108. In this manner, the monitoring unit 108 is powered by a slipstream of the electricity that is being delivered to the motor 138 via the ESP power cable 146.

The monitoring unit 108 is configured to measure key parameters relating to the motor 138 and the pump intake 142, such as, for example, downhole vibration, motor oil temperature, motor winding temperature, intake pressure, intake temperature, water ingress, current leakage, wye voltage, and the like. These measurements are then communicated to an ESP surface unit 156 via the ESP power cable 146. Specifically, as indicated by dotted line 158, the sensor data are transmitted as a modulated signal that represents a serial digital data stream. In various embodiments, the modulated signal is generated by modulation circuitry, in cooperation with a microprocessor, within the monitoring unit 108. The modulated signal is then supplied to the motor wye point and is communicated over the conductors of the ESP power cable 146.

In various embodiments, the ESP surface unit 156 includes a surface choke 160, an ESP interface board 162, and a surface interface panel 164. As indicated by line 166, the surface choke 160 is used to isolate the motor voltage from the modulated signal before the modulated signal is received and interpreted by the ESP interface board 162. Specifically, the surface choke 160 includes demodulation circuitry that recovers the digital data stream from the modulated signal and supplies the recovered digital data stream to the ESP interface board 162. The ESP interface board 162 then interprets the digital data stream and (optionally) provides feedback relating to the data stream to the VSD 150, as indicated by dotted line 168. The VSD 150 may then use the feedback to determine the proper flow of electricity to the motor 138. In some embodiments, the interpreted data stream is also output to a surface interface panel 164, and then to the ESP operator via one or more remote devices, such as the laptop computer 170 shown in FIG. 1.

The ESP operator then uses the information provided by these measurements for ESP surveillance, troubleshooting, and optimization. For example, the ESP operator may use the information to proactively intervene when the performance of the ESP system is gradually declining. In this manner, such information can be used to extend the run life of the ESP system, as well as boost production from the hydrocarbon well. In addition, in some cases, such information can provide helpful insight into the characteristics of the reservoir, which may be used to further improve production.

In some embodiments, the ESP operator may intervene by adjusting the frequency of the motor 138 or adjusting the voltage transmitted to the motor 138. Moreover, in some embodiments, the VSD 150 is configured to automatically adjust the frequency and/or voltage of the motor 138, or automatically shut down the motor 138, in response to receiving certain feedback from the ESP interface board 162. For example, if the feedback indicates that the value of a particular parameter exceeds a specific threshold, an electrical switch within the VSD 150 may automatically trip, shutting down the motor 138.

The discharge pressure of the pump 110 is one important parameter that cannot be directly measured by the monitoring unit 108 without the installation of additional equipment. The discharge pressure can be used to calculate the differential pressure across the pump 110 to evaluate its performance and to quickly identify a potential deadhead condition. In addition, the discharge pressure can be used to determine the hydrostatic pressure gradient in the production tubing 130 above the ESP system 102, which can be used to determine the fluid composition within the production tubing 130 and, thus, protect the pump 110 from damage caused by heavy fluid slugs. Furthermore, the discharge pressure can be used to protect the pump 110 from damage caused by pressure buildup, such as pressure buildup caused by an unintentionally closed valve at the wellhead 120.

According to the embodiment shown in FIG. 1, the ESP system 102 includes additional equipment that enables the monitoring unit 108 to measure the discharge pressure. Specifically, the ESP system 102 includes the pump discharge sub 104 and the hydraulic line 106 installed above the pump discharge 144. This enables the monitoring unit 108 to measure the discharge pressure applied to the hydraulic line 106 by the pump 110. The hydraulic line is typically 0.25 to 0.375 inches in diameter and is banded to the outside of the pump 110, the protector 140, and the motor 138. In addition, the hydraulic line 106 may be more than 100 feet long, depending on the distance from the monitoring unit 108 to the pump discharge 144. As a result, this technique for measuring the discharge pressure increases the overall outer diameter of the ESP system 102. Therefore, this solution is not an option when the inner diameter of the production casing string 126 is limited, such as, for example, when heavy-walled casing is used.

Exemplary Hydrocarbon Well Including ESP System with ESP Monitoring System

Figure 2:
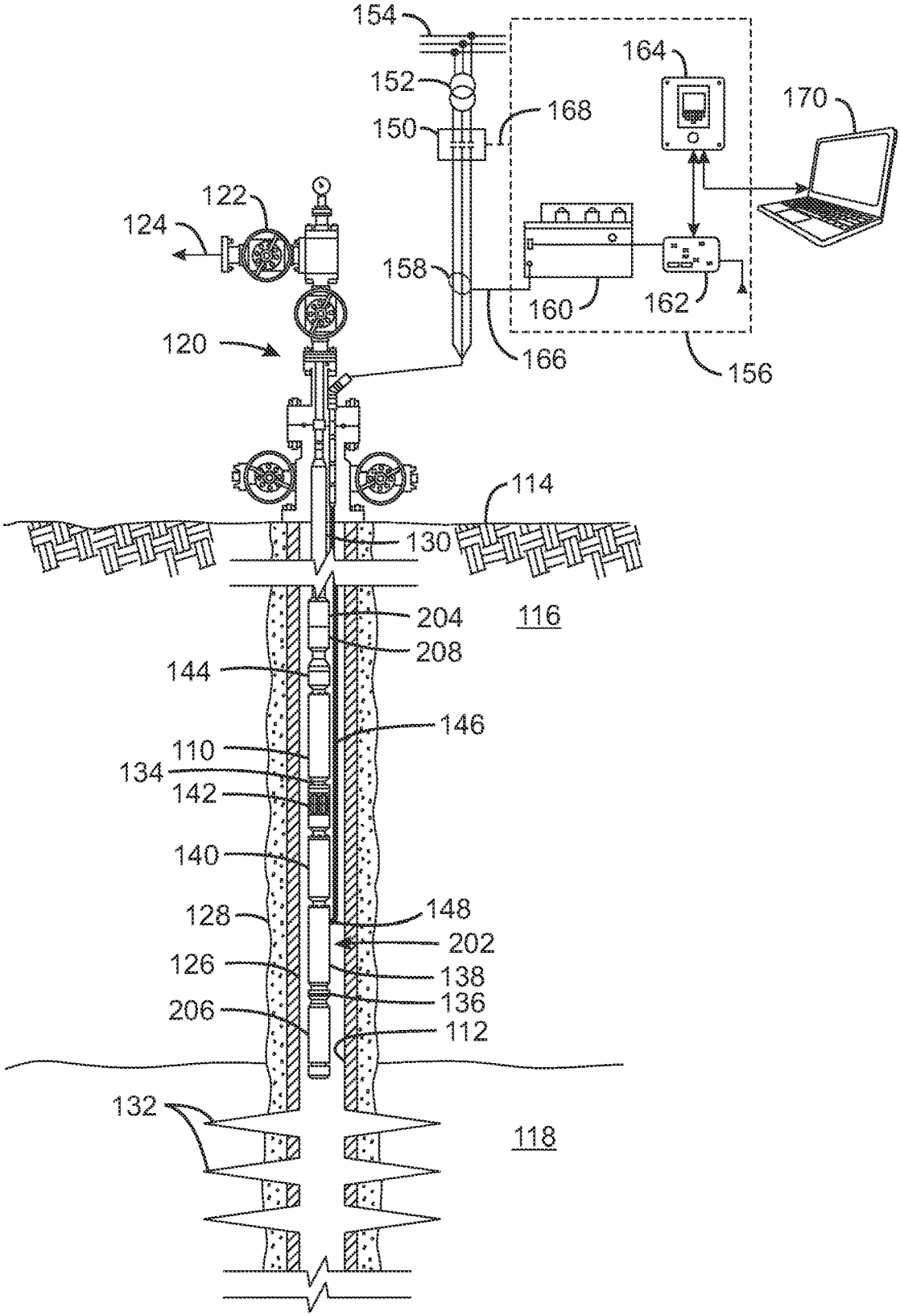
FIG. 2 is a cross-sectional schematic view of an exemplary hydrocarbon well including an ESP system with the ESP monitoring system described herein.

FIG. 2 is a cross-sectional schematic view of an exemplary hydrocarbon well 200 including an ESP system 202 with the ESP monitoring system described herein. Like numbered items are as described with respect to FIG. 1. As shown in FIG. 2, the ESP monitoring system described herein includes a discharge monitoring unit 204 that is hydraulically coupled to the pump discharge 144 such that it comes into contact with hydrocarbon fluids exiting the pump 110 of the ESP system 202. The discharge monitoring unit 204 includes a combination of sensors and other components that are configured to measure, or sense, one or more discharge parameters relating to the pump 110, as well as collect and transmit data corresponding to such discharge parameters. Such discharge parameters may include, for example, discharge pressure, discharge temperature, and/or vibration near the pump discharge 144.

In addition, the ESP monitoring system described herein includes a base monitoring unit 206 that is electrically connected to the motor 138 of the ESP system 202 via the motor wye point within the motor base crossover 136. The base monitoring unit 206 includes a combination of sensors and other components that are configured to measure, or sense, one or more base parameters relating to the motor 138 and/or the pump intake 142, as well as collect and transmit data corresponding to such base parameters. Such base parameters may include, for example, downhole vibration, motor oil temperature, motor winding temperature, intake pressure, intake temperature, water ingress, current leakage, and/or wye voltage.

According to embodiments described herein, the discharge monitoring unit 204 and the base monitoring unit 206 are communicably coupled via a ground path. As described further with respect to FIGS. 3 and 4, in various embodiments, the ground path is provided by the armor of the ESP power cable 146. In other embodiments, the ground path is provided by any combination of the armor of the ESP power cable 146, the housing of one or more components of the ESP system 102, the production tubing 130, and the production casing string 126. For example, if the ESP power cable 146 is resting against the production casing string 126 due to the limited inner diameter of the production casing string 126, then the production casing string 126, in combination with the cable armor and/or the housing of the ESP system components, may act as the ground path.

In various embodiments, the discharge monitoring unit 204 transmits data relating to the measured discharge parameters directly to the base monitoring unit 206 via the ground path. More specifically, in various embodiments, the sensor data from the discharge monitoring unit 204 is communicated to the base monitoring unit 206 as a modulated signal traveling through the ground path. The base monitoring unit 206 may then combine the data relating to the discharge parameter(s) with the data relating to the base parameter(s), and transmit the combined data to the ESP surface unit 156 via the ESP power cable 146, i.e., as a modulated signal that is supplied to the motor wye point and is communicated over the conductors of the ESP power cable 146. In various embodiments, integrating the discharge monitoring unit 204 with the base monitoring unit 206 using the ground path allows pump discharge parameters to be reliably measured and transmitted without increasing the overall outer diameter of the ESP system 202. As a result, the ESP system 202 of FIG. 2 is highly suitable for applications in which the inner diameter of the production casing string 126 is limited.

Many components of the base monitoring unit 206 may be the same as, or similar to, the components of the monitoring unit 108 described with respect to FIG. 1. However, in various embodiments, the base monitoring unit 206 is modified to include additional circuitry and/or components relating to the discharge monitoring unit 204. For example, the base monitoring unit 206 may be modified to include a frequency counter and/or a memory device correlating to the discharge monitoring unit 204, as described further with respect to FIG. 5. As another example, the base monitoring unit 206 may include additional circuitry for combining the data received from the discharge monitoring unit 204 with the data measured by the base monitoring unit 206. Moreover, as another example, the base monitoring unit 206 may include additional circuitry for requesting specific data from the discharge monitoring unit 204, as described further herein.

The discharge monitoring unit 204 described herein may include any suitable type of pressure transducer and/or other sensing device that is rated for downhole conditions. In various embodiments, the discharge monitoring unit 204 is configured to record a pressure signal (and/or a temperature signal) and convert the pressure signal to an output frequency. The output frequency is then transmitted to the base monitoring unit 206 for conversion to pressure information and communication back to the ESP surface unit 156 with the sensor data recorded by the base monitoring unit 206. In other embodiments, rather than converting the pressure signal to an output frequency, the discharge monitoring unit 204 converts the pressure signal to an output voltage or current, or to any other electrical signal that can be readily transmitted to the base monitoring unit 206 via the ground path.

Because the base monitoring unit 206 uses the reference between the motor wye point and the ground path to communicate to the ESP surface unit 156, those conduction pathways are already being monitored by the base monitoring unit 206. Therefore, according to embodiments described herein, the discharge monitoring unit 204 sends the output frequency (or other electrical signal) directly to the ground path, e.g., the armor of the ESP power cable 146, with an integral amplifier to boost the signal if needed. The frequencies output from the discharge monitoring unit 204 may be in the range of 10 kilohertz (kHz) or more, which is much higher than ESP operating frequencies, which are typically around 60 Hz, and variable frequency drive carrier frequencies, which are typically around 2 kHz. In various embodiments, the base monitoring unit 206 reads the output frequency from the ground path using the motor wye point as a reference to measure the discharge pressure (and/or other discharge parameters). Further, in some embodiments, the base monitoring unit 206 alternates between receiving the signal from the ground path and communicating to the ESP surface unit 156 to prevent interference between the two signals.

In various embodiments, the signal sent from the discharge monitoring unit 204 to the base monitoring unit 206 only has to travel through the ground path, e.g., the armor, for a distance of around 200 feet or less, while the signal sent from the base monitoring unit 206 to the ESP surface unit 156 has to travel thousands of feet through the ESP power cable 146. Therefore, the signal sent from the discharge monitoring unit 204 to the base monitoring unit 206 may be much weaker than the signal sent from the base monitoring unit 206 to the ESP surface unit 156. As a result, in various embodiments, the signal sent from the base monitoring unit 206 is strong enough to overwhelm the signal sent from the discharge monitoring unit 204, thus ensuring that the main sensor communications reach the ESP surface unit 156.

In various embodiments, because the pump intake temperature and the pump discharge temperature are typically relatively close to one another, the base monitoring unit 206 is configured to adjust pressure measurements received from the discharge monitoring unit 204 for temperature dependence by using the temperature measurements taken locally by the base monitoring unit 206. In this manner, combining the measurements taken by the base monitoring unit 206 with the measurements taken by the discharge monitoring unit 204 allows for the transmission of simplified data that can be easily analyzed by the ESP surface unit 156.

Further, in various embodiments, the discharge monitoring unit 204 is configured to receive data requests from the base monitoring unit 206. For example, in some embodiments, the base monitoring unit 206 sends cyclic requests to the discharge monitoring unit 204, requesting data corresponding to one discharge parameter on each cycle. For example, the base monitoring unit 206 may request data corresponding to the discharge pressure on one cycle, request data corresponding to the discharge temperature on the next cycle, and then repeat this process indefinitely. In other embodiments, the discharge monitoring unit 204 operates independently of the base monitoring unit 206, meaning that the discharge monitoring unit 204 automatically sends data to the base monitoring unit 206 without receiving any requests from the base monitoring unit 206.

As shown in FIG. 2, in various embodiments, the discharge monitoring unit 204 includes a power source 208. In some embodiments, the power source 208 is a battery pack. In other embodiments, the power source 208 is a power-generation device that is configured to generate power within the downhole environment. For example, the power source 208 may be configured to utilize a slipstream of the hydrocarbon fluids flowing through the pump discharge 144 to spin a turbine and a generator. As another example, the power source 208 may utilize the temperature difference between the produced hydrocarbon fluids and the annular fluids to drive a thermoelectric generator. As another example, the power source 208 may include a piezoelectric device that harvests power from the natural vibrations within the downhole environment. Moreover, as another example, the power source 208 may take advantage of the rotating shaft 134 within the ESP system 202 to generate electricity, i.e., via a rotating magnetic coil, for example.

In other embodiments, the discharge monitoring unit 204 does not include the power source 208 but, rather, is powered by the ESP power cable 146. For example, the incoming power phases within the ESP power cable 146 may be temporarily separated within proximity to the discharge monitoring unit 204. A coil on one of the phases may provide power to the discharge monitoring unit 204, while a coil on another phase may allow the discharge monitoring unit 204 to impress a signal on the line continuing to the base monitoring unit 206.

The cross-sectional schematic view of FIG. 2 is not intended to indicate that the hydrocarbon well 200 and the ESP system 202 are to include all of the components shown in FIG. 2, or that the hydrocarbon well 200 or the ESP system 202 is limited to only the components shown in FIG. 2. Rather, any number of components may be omitted from the hydrocarbon well 200 and/or the ESP system 202, or added to the hydrocarbon well 200 and/or the ESP system 202, depending on the details of the specific implementation.

Operation of ESP Monitoring System

Figure 3:
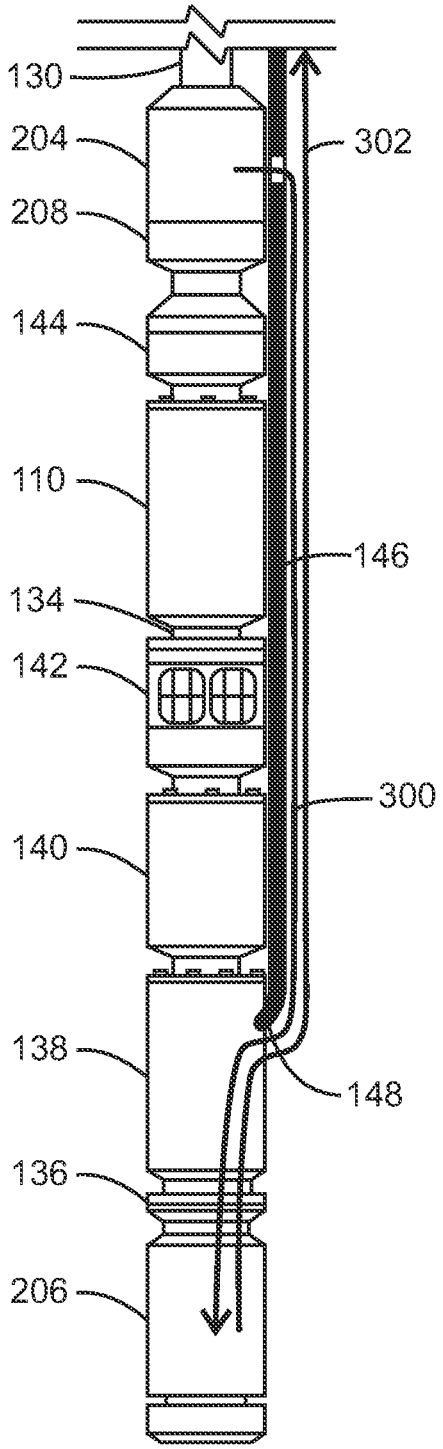
FIG. 3 is a schematic view of the ESP system of FIG. 2 showing an exemplary embodiment of the manner in which information travels between the discharge monitoring unit and the base monitoring unit of the ESP monitoring system, as well as between the base monitoring unit and the ESP surface unit.

FIG. 3 is a schematic view of the ESP system 202 of FIG. 2 showing an exemplary embodiment of the manner in which information travels between the discharge monitoring unit 204 and the base monitoring unit 206 of the ESP monitoring system, as well as between the base monitoring unit 206 and the ESP surface unit 156. Like numbered items are as described with respect to FIGS. 1 and 2. Specifically, as indicated by arrow 300, data may be transmitted from the discharge monitoring unit 204 to the base monitoring unit 206 via the armor of the ESP power cable 146 and/or the housing of one or more components, such as the motor 138 and the motor base crossover 136. In addition, as indicated by arrow 302, data may be transmitted from the base monitoring unit 206 to the ESP surface unit 156 via the ESP power cable 146.

The schematic view of FIG. 3 is not intended to indicate that information always travels between the discharge monitoring unit 204, the base monitoring unit 206, and the ESP surface unit 156 in the manner shown in FIG. 3. Rather, in some embodiments, the discharge monitoring unit 204 outputs sensor data straight to the ESP surface unit 156 via the armor of the ESP power cable 146, rather than sending the sensor data down to the base monitoring unit 206.

Figure 4:
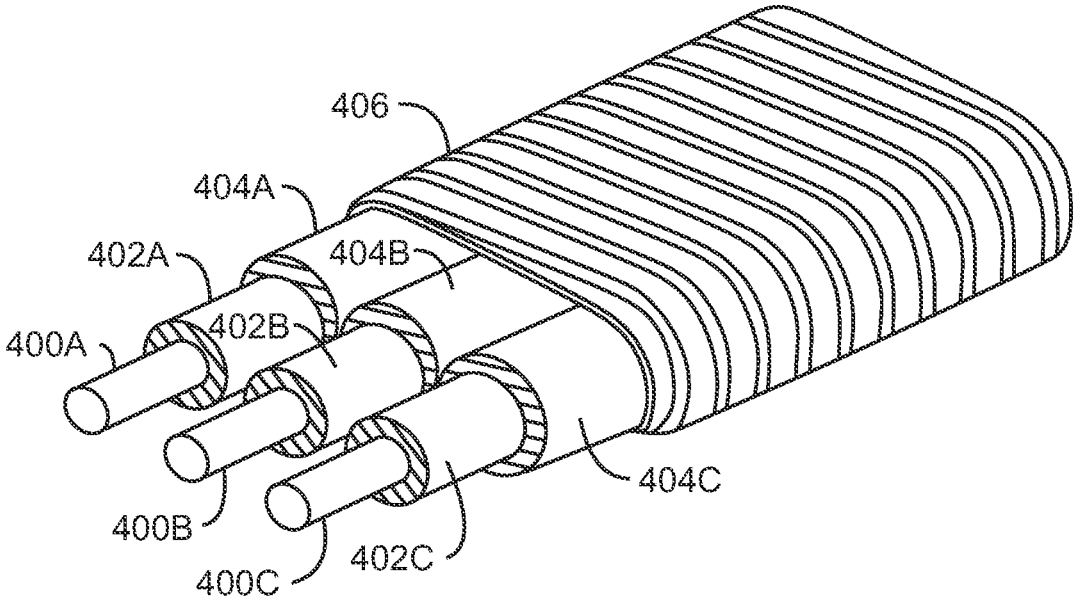
FIG. 4 is a perspective view of an exemplary embodiment of the ESP power cable described with respect to FIGS. 1-3.

FIG. 4 is a perspective view of an exemplary embodiment of the ESP power cable 146 described with respect to FIGS. 1-3. Like numbered items are as described with respect to FIGS. 1-3. As shown in FIG. 4, the ESP power cable 146 may be an electrical cable including three conductors 400A-C, which may be soft-drawn, tin-coated copper (SDTC) conductors, for example. Each conductor 400A-C is wrapped in insulation 402A-C, which may be high-dielectric thermoplastic insulation, for example, as well as an outer jacket 404A-C, which may be constructed from electrical-grade thermoplastic insulation, for example.

The size of the conductors 400A-C may be selected based on the motor current load, and the voltage rating of the insulation 402A-C may be selected based on the motor voltage.

In some embodiments, the ESP power cable 146 is a flat cable, as shown in FIG. 4. In many cases, flat cables are used for downhole applications due to the limited inner diameter of the casing. However, round cables may also be used, depending on the details of the specific implementation.

The ESP power cable 146 also includes an armor 406. In some embodiments, the armor 406 is constructed of galvanized steel, which provides mechanical protection that allows the ESP power cable 146 to withstand high stress environments. Moreover, in various embodiments, the armor 406 is connected to earth and is used as the circuit protective conductor, or "earth wire", for the downhole equipment supplied by the ESP power cable 146. Furthermore, as described with respect to FIGS. 2 and 3, the armor 406 may also act as the conductive pathway for communicating sensor communications between the discharge monitoring unit 204 and the base monitoring unit 206, as described herein.

The perspective view of FIG. 4 is not intended to indicate that the ESP power cable 146 is to be constructed exactly as shown in FIG. 4. Rather, it will be appreciated by one of skill in the art that a wide range of cable sizes and construction types may be used. In general, several different factors, such as, for example, wellbore conditions, available space, and motor size, will be used to determine the most suitable cable type for each particular implementation.

In some embodiments, the ESP power cable includes a fourth conductor (not shown) that acts as the ground path. In such embodiments, the sensor communications described herein may be sent from the discharge monitoring unit 204 to the base monitoring unit 206 via the fourth conductor, rather than the armor 406.

Figure 5:
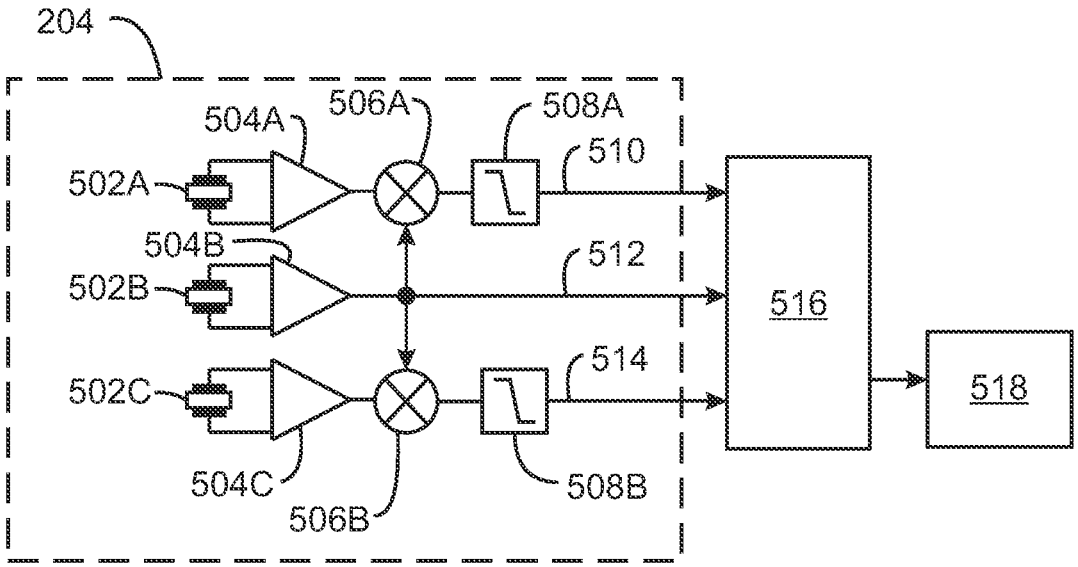
FIG. 5 is a simplified block diagram of an exemplary circuit that may be used for the discharge monitoring unit described herein.

FIG. 5 is a simplified block diagram of an exemplary circuit 500 that may be used for the discharge monitoring unit 204 described herein. According to the exemplary circuit 500 shown in FIG. 5, the discharge monitoring unit 204 is a conventional pressure transducer. The circuit 500 include a first oscillator having a first resonator 502A, such as a crystal resonator, driven by a first amplifier 504A. The first amplifier 504A drives the first resonator 502A to provide a sensor for measuring pressure. The circuit 500 also include a second oscillator having a second resonator 502B, such as a crystal resonator, driven by a second amplifier 504B. The second amplifier 504B drives the second resonator 502B to provide a reference sensor. In addition, the circuit 500 includes a third oscillator having a third resonator 502C, i.e., a crystal resonator, driven by a third amplifier 504C. The third amplifier 504C drives the third resonator 502C to provide a sensor for measuring temperature.

The circuit 500 includes two mixers 506A and 506B, which combine the pressure and temperature signals output by the first and third resonators 502A and 502C, respectively, with the reference signal output by the second resonator 502B. The resulting signals are then sent through low-pass filters 508A and 508B, resulting in a low-frequency pressure output signal 510, a high-frequency reference output signal 512, and a low-frequency temperature output signal 514. In various embodiments, the discharge monitoring unit 204 includes additional circuitry for transmitting the low-frequency pressure output signal 510 and/or the low-frequency temperature output signal 514 to the base monitoring unit 206.

In some embodiments, the discharge monitoring unit 204 is coupled to a frequency counter 516 and, optionally, a memory device 518, such as, for example, a serial electrically-erasable, programmable, or read-only memory (EEPROM) device. In some embodiments, the frequency counter 516 and/or the memory device 518 are integrated directly within the discharge monitoring unit 204. In other embodiments, the discharge monitoring unit 204 does not include its own frequency counter 516 and/or memory device 518 but, rather, utilizes the frequency counter 516 and/or the memory device 518 integrated within the base monitoring unit 206. Providing further integration between the discharge monitoring unit 204 and the base monitoring unit 206 in this manner may decrease the overall size of the discharge monitoring unit 204. This, in turn, may increase the cost-effectiveness of the ESP monitoring system described herein.

Method for Measuring and Transmitting Parameters Relating to ESP System

Figure 6:
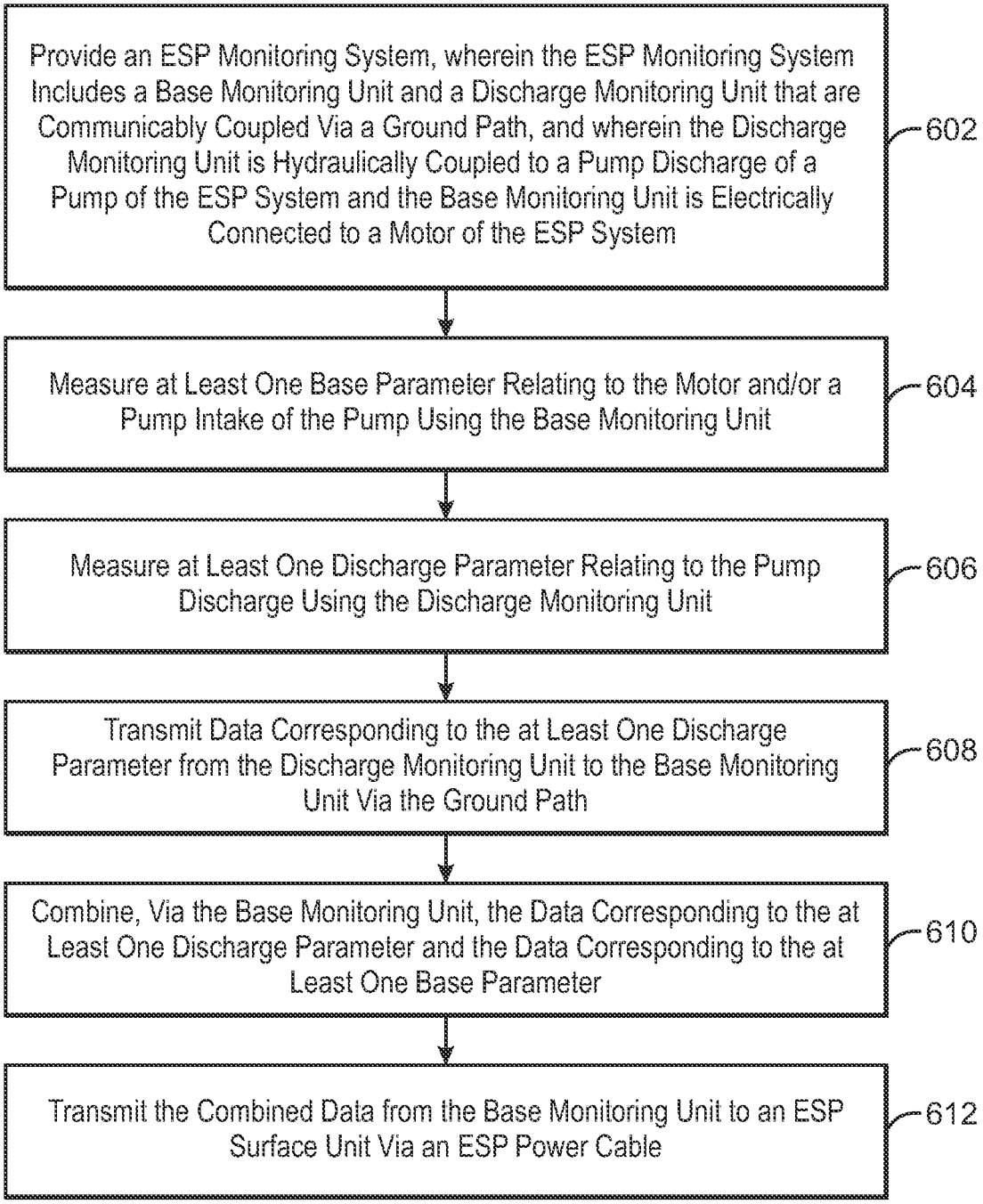
FIG. 6 is a process flow diagram of a method for measuring and transmitting parameters relating to an ESP system.

FIG. 6 is a process flow diagram of a method for measuring and transmitting parameters relating to an electric submersible pump (ESP) system. The method 600 begins at block 602, at which an ESP monitoring system is provided. The ESP monitoring system is installed within an ESP system and includes a base monitoring unit and a discharge monitoring unit that are communicably coupled via a ground path. The discharge monitoring unit is hydraulically coupled to the pump discharge of the pump of the ESP system, and the base monitoring unit is electrically connected to the motor of the ESP system.

At block 604, at least one base parameter relating to the motor and/or a pump intake of the pump is measured using the base monitoring unit. In various embodiments, this includes measuring the downhole vibration, the motor oil temperature, the motor winding temperature, the intake pressure, the intake temperature, the water ingress, the current leakage, and/or the wye voltage.

At block 606, at least one discharge parameter relating to the pump discharge is measured using the discharge monitoring unit. In various embodiments, this includes measuring the discharge pressure, the discharge temperature, and/or the vibration near the pump discharge.

At block 608, data corresponding to the at least one discharge parameter is transmitted from the discharge monitoring unit to the base monitoring unit via a ground path. In some embodiments, the ground path is the armor of the ESP power cable. In other embodiments, the ground path is any combination of the armor of the ESP power cable, the housing of one or more components of the ESP system, the production tubing, and the casing of the wellbore. In addition, in some embodiments, the method 600 includes boosting the output signal of the discharge monitoring unit using an integral amplifier within the discharge monitoring unit.

At block 610, the data corresponding to the at least one discharge parameter and the data corresponding to the at least one base parameter are combined via the base monitoring unit. At block 612, the combined data is transmitted from the base monitoring unit to an ESP surface unit via the ESP power cable. In some embodiments, the method 600 also includes overwhelming the transmission from the discharge monitoring unit to the base monitoring unit with the transmission from the base monitoring unit to the ESP surface unit to ensure that the combined data reach the ESP surface unit. Furthermore, in some embodiments, the method 600 includes alternating, via the base monitoring unit, between receiving the transmitted data from the discharge monitoring unit at the base monitoring unit and transmitting the combined data from the base monitoring unit to the ESP surface unit.

In various embodiments, the method 600 includes measuring, via the discharge monitoring unit, the at least one discharge parameter by recording a pressure signal, converting, via the discharge monitoring unit, the pressure signal to an output frequency, and transmitting the output frequency from the discharge monitoring unit to the base monitoring unit as the data corresponding to the at least one discharge parameter. In addition, in such embodiments, the method 600 may include reading, via the base monitoring unit, the output frequency from the ground path using a motor wye point as a reference, converting, via the base monitoring unit, the output frequency to pressure information, combining, via the base monitoring unit, the pressure information with any pressure information recorded by the base monitoring unit, and transmitting the combined pressure information from the base monitoring unit to the ESP surface unit via the ESP power cable. Moreover, in such embodiments, the pressure signal may alternatively be converted to an output voltage or an output current rather than the output frequency.

The process flow diagram of FIG. 6 is not intended to indicate that the steps of the method 600 are to be executed in any particular order, or that all of the steps of the method 600 are to be included in every case. Further, any number of additional steps not shown in FIG. 6 may be included within the method 600, depending on the details of the specific implementation. For example, in some embodiments, the method 600 includes powering the discharge monitoring unit via a power source that is coupled to the discharge monitoring unit. In other embodiments, the method 600 includes powering the discharge monitoring unit via the ESP power cable.

In some embodiments, the method 600 also includes requesting, via the base monitoring unit, the data corresponding to the at least one discharge parameter from the discharge monitoring unit. This may include sending, via the base monitoring unit, the requests to the discharge monitoring unit in a cycle such that the data corresponding to each discharge parameter are transmitted separately.

While the embodiments described herein are well-calculated to achieve the advantages set forth, it will be appreciated that the embodiments described herein are susceptible to modification, variation, and change without departing from the spirit thereof. Indeed, the present techniques include all alternatives, modifications, and equivalents falling within the true spirit and scope of the appended claims.

What is claimed is:

1. An electric submersible pump (ESP) monitoring system, comprising:

a base monitoring unit; and a discharge monitoring unit that is communicably coupled to the base monitoring unit via a ground path;

wherein the discharge monitoring unit is hydraulically coupled to a pump discharge of a pump of an ESP system and is configured to:

measure at least one discharge parameter relating to the pump discharge; and transmit data corresponding to the at least one discharge parameter to the base monitoring unit via the ground path; and wherein the base monitoring unit is electrically connected to a motor of the ESP system and is configured to:

measure at least one base parameter relating to the motor and/or a pump intake of the pump;

receive the transmitted data corresponding to the at least one discharge parameter from the discharge monitoring unit;

combine the data corresponding to the at least one discharge parameter and data corresponding to the at least one base parameter; and transmit the combined data to an ESP surface unit via an ESP power cable.

2. The ESP monitoring system of claim 1, wherein the ground path comprises an armor of the ESP power cable.

3. The ESP monitoring system of claim 1, wherein the ground path comprises any combination of an armor of the ESP power cable, a housing of one or more components of the ESP system, a production tubing, and a casing of a wellbore.

4. The ESP monitoring system of claim 1, wherein the at least one base parameter comprises at least one of a downhole vibration, a motor oil temperature, a motor winding temperature, an intake pressure, an intake temperature, a water ingress, a current leakage, and a wye voltage.

5. The ESP monitoring system of claim 1, wherein the at least one discharge parameter comprises at least one of a discharge pressure, a discharge temperature, or a vibration near the pump discharge.

6. The ESP monitoring system of claim 1, wherein the discharge monitoring unit is configured to:

measure the at least one discharge parameter by recording a pressure signal;

convert the pressure signal to an output frequency; and transmit the output frequency to the base monitoring unit as the data corresponding to the at least one discharge parameter.

7. The ESP monitoring system of claim 6, wherein the base monitoring unit is electrically connected to a motor wye point of the motor, and wherein the base monitoring unit is configured to:

receive the transmitted data from the discharge monitoring unit by reading the output frequency from the ground path using the motor wye point as a reference;

convert the output frequency to pressure information;

combine the pressure information with any pressure information recorded by the base monitoring unit; and transmit the combined pressure information to the ESP surface unit via the ESP power cable.

8. The ESP monitoring system of claim 6, wherein the discharge monitoring unit converts the pressure signal to an output voltage or an output current rather than the output frequency.

9. The ESP monitoring system of claim 1, wherein the discharge monitoring unit comprises a pressure transducer that is rated for downhole conditions.

10. The ESP monitoring system of claim 1, wherein the transmission from the base monitoring unit to the ESP surface unit is configured to overwhelm the transmission from the discharge monitoring unit to the base monitoring unit to ensure that the combined data reach the ESP surface unit.

11. The ESP monitoring system of claim 1, wherein the base monitoring unit is configured to alternate between receiving the transmitted data from the discharge monitoring unit and transmitting the combined data to the ESP surface unit.

12. The ESP monitoring system of claim 1, wherein the base monitoring unit is configured to request the data corresponding to the at least one discharge parameter from the discharge monitoring unit.

13. The ESP system of claim 12, wherein the base monitoring unit is configured to send the requests to the discharge monitoring unit in a cycle such that the data corresponding to each discharge parameter are transmitted separately.

14. The ESP monitoring system of claim 1, wherein the discharge monitoring unit comprises a power source.

15. The ESP monitoring system of claim 14, wherein the power source comprises a power-generation device that is configured to generate power downhole.

16. A method for measuring and transmitting parameters relating to an electric submersible pump (ESP) system, comprising:

providing an ESP monitoring system, wherein the ESP monitoring system comprises a base monitoring unit and a discharge monitoring unit that are communicably coupled via a ground path, and wherein the discharge monitoring unit is hydraulically coupled to a pump discharge of a pump of the ESP system and the base monitoring unit is electrically connected to a motor of the ESP system;

measuring at least one base parameter relating to the motor and/or a pump intake of the pump using the base monitoring unit;

measuring at least one discharge parameter relating to the pump discharge using the discharge monitoring unit;

transmitting data corresponding to the at least one discharge parameter from the discharge monitoring unit to the base monitoring unit via a ground path;

combining, via the base monitoring unit, the data corresponding to the at least one discharge parameter and data corresponding to the at least one base parameter; and transmitting the combined data from the base monitoring unit to an ESP surface unit via an ESP power cable.

17. The method of claim 16, wherein transmitting the data corresponding to the at least one discharge parameter via the ground path comprises transmitting the data via an armor of the ESP power cable.

18. The method of claim 16, wherein transmitting the data corresponding to the at least one discharge parameter via the ground path comprises transmitting the data via any combination of an armor of the ESP power cable, a housing of one or more components of the ESP system, a production tubing, and a casing of a wellbore.

19. The method of claim 16, wherein measuring the at least one base parameter comprises measuring at least one of a downhole vibration, a motor oil temperature, a motor winding temperature, an intake pressure, an intake temperature, a water ingress, a current leakage, and a wye voltage.

20. The method of claim 16, wherein measuring the at least one discharge parameter comprises measuring at least one of a discharge pressure, a discharge temperature, or a vibration near the pump discharge.

21. The method of claim 16, comprising:

measuring, via the discharge monitoring unit, the at least one discharge parameter by recording a pressure signal;

converting, via the discharge monitoring unit, the pressure signal to an output frequency; and transmitting the output frequency from the discharge monitoring unit to the base monitoring unit as the data corresponding to the at least one discharge parameter.

22. The method of claim 21, comprising:

reading, via the base monitoring unit, the output frequency from the ground path using a motor wye point as a reference;

converting, via the base monitoring unit, the output frequency to pressure information;

combining, via the base monitoring unit, the pressure information with any pressure information recorded by the base monitoring unit; and transmitting the combined pressure information from the base monitoring unit to the ESP surface unit via the ESP power cable.

23. The method of claim 21, comprising converting the pressure signal to an output voltage or an output current rather than the output frequency.

24. The method of claim 16, comprising powering the discharge monitoring unit via a power source that is coupled to the discharge monitoring unit.

25. An electric submersible pump (ESP) system, comprising:

a shaft;

a motor configured to rotate the shaft in response to receiving power via an ESP power cable;

a pump that is operatively coupled to the shaft, wherein the pump comprises a pump intake and a pump discharge; and an ESP monitoring system, comprising:

a base monitoring unit; and a discharge monitoring unit that is communicably coupled to the base monitoring unit via a ground path;

wherein the discharge monitoring unit is hydraulically coupled to the pump discharge and is configured to:

measure at least one discharge parameter relating to the pump discharge; and transmit data corresponding to the at least one discharge parameter to the base monitoring unit via the ground path; and wherein the base monitoring unit is electrically connected to the motor and is configured to:

measure at least one base parameter relating to the motor and/or the pump intake;

receive the transmitted data corresponding to the at least one discharge parameter from the discharge monitoring unit;

combine the data corresponding to the at least one discharge parameter and data corresponding to the at least one base parameter; and transmit the combined data to an ESP surface unit via the ESP power cable.

* * * * *